US011724367B2

(12) United States Patent
Eriksson et al.

(10) Patent No.: US 11,724,367 B2
(45) Date of Patent: Aug. 15, 2023

(54) ATTACHMENT PART FOR A POWER TOOL AND A TOOL ASSEMBLY

(71) Applicant: ATLAS COPCO INDUSTRIAL TECHNIQUE AB, Stockholm (SE)

(72) Inventors: Ulf Mikael Eriksson, Vallentuna (SE); Wojtek Malinowski, Danderyd (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 404 days.

(21) Appl. No.: 17/258,799

(22) PCT Filed: Jun. 20, 2019

(86) PCT No.: PCT/EP2019/066336
§ 371 (c)(1),
(2) Date: Jan. 8, 2021

(87) PCT Pub. No.: WO2020/011510
PCT Pub. Date: Jan. 16, 2020

(65) Prior Publication Data

US 2021/0276163 A1 Sep. 9, 2021

(30) Foreign Application Priority Data

Jul. 12, 2018 (SE) ..... 1850890-3

(51) Int. Cl.
*B25B 21/00* (2006.01)

(52) U.S. Cl.
CPC ..... *B25B 21/002* (2013.01); *B25B 21/007* (2013.01)

(58) Field of Classification Search
CPC ..... B25B 21/002; B25B 21/007; B25B 17/00; B25B 13/48; B25B 13/481
See application file for complete search history.

(56) References Cited

U.S. PATENT DOCUMENTS 4,942,794 A 7/1990 Snyder et al.
7,631,580 B2 * 12/2009 Lu ..... B25B 13/488 81/57.14

(Continued)

FOREIGN PATENT DOCUMENTS

WO 2014095517 A1 6/2014

OTHER PUBLICATIONS

U.S. Appl. No. 17/258,788; First Named Inventor: Per Ingemar FORSBERG; Title: "Power Tool Attachment Part"; Filed: Jan. 8, 2021.

(Continued)

*Primary Examiner* — David B. Thomas
(74) *Attorney, Agent, or Firm* — Holtz, Holtz & Volek PC

(57) ABSTRACT

An attachment part for a power tool includes an elongated housing including an upper housing part, a lower housing part and an interconnection structure that interconnects the upper and lower housing parts. An input gear for connection to an output shaft of a power tool is arranged at a first end of the housing. An output gear with an output interface is arranged at a second end of the housing. The interconnecting structure includes a sleeve member extending through a first central bore at the first end of the upper housing part, which sleeve member receives the input gear, and a fixation member extending through a second central bore at the first end of the lower housing part and which is arranged to be secured to the sleeve member to clamp the upper and lower housing parts. A tool assembly includes a power tool and the attachment part.

14 Claims, 5 Drawing Sheets

(56) References Cited

U.S. PATENT DOCUMENTS

| | | | | |
|---|---|---|---|---|
| 7,874,232 | B2 * | 1/2011 | Gauthreaux | B25B 23/0035 81/58 |
| 8,671,804 | B2 * | 3/2014 | Galat | B25B 21/002 81/57.14 |
| 2015/0314427 | A1 | 11/2015 | Carlsson et al. | |
| 2016/0167207 | A1 * | 6/2016 | Badiali | B25B 23/0028 81/57.3 |
| 2017/0001288 | A1 | 1/2017 | Kargenian et al. | |

OTHER PUBLICATIONS

International Preliminary Report on Patentability (IPRP) dated Jun. 23, 2020 issued in International Application No. PCT/EP2019/066336.

International Search Report (ISR) dated Oct. 10, 2019 issued in International Application No. PCT/EP2019/066336.

Written Opinion dated Oct. 10, 2019 issued in International Application No. PCT/EP2019/066336.

* cited by examiner

ATTACHMENT PART FOR A POWER TOOL AND A TOOL ASSEMBLY

TECHNICAL FIELD

The present disclosure generally relates to power tools. In particular it relates to an attachment part for a power tool.

A power tool attachment part is generally used in confined spaces where it is not possible to use an ordinary power tool such as an ordinary nutrunner, due to that it is difficult to access the bolt or nut of the joint to be fastened or loosened. An attachment part is also known as a crowfoot, a front part attachment, an offset attachment or an offset gearhead. Below it will be referred to as an attachment part.

BACKGROUND

An attachment part includes a number of gears that transmit a rotating movement from an input gear with an input interface to an output gear with an output interface. At so called closed end attachment parts, the gears are generally located in a straight row, in meshing relationship, inside an elongate housing. At open end attachment parts, the output gear and output interface exhibit a slit for allowing the output interface to engage a pipe or the like in the radial direction in order to engage an nut or the like which enclose the pipe. For this reason, at open end attachment parts, the output gear meshes with two intermediate gears which, in turn mesh with the last one of a number of gears arranged in a straight row.

In both cases, the housing comprises a first end which houses the input gear, a second end which houses the output gear and an intermediate portion which connects the first and second ends. The input gear is often connected to or formed integral with an input interface which is arranged coaxial with the input gear for transmitting torque from the output shaft of the power tool. Typically, the output shaft of the power tool is formed of a square drive and the input interface exhibits a square recess with dimensions corresponding to the dimensions of the square drive. The square drive of many commonly used power tools and angle heads are standardized to specific dimensions, typically ¼, ⅜, ½ or 1 inch, depending of the torque to be transmitted. For receiving such standardized square drives, the diameter of the input interface sometimes needs to be larger than the gears arranged in the housing for transmitting the torque to the output interface.

This, in combination with that the input interface normally should be supported in bearings surrounding the input interface which also should form a connection to an adaptor for the attachment part, results in that the first end of the housing often has larger dimensions than the second end and the intermediate portion of the housing. Typically, the first end forms a generally cylindrical portion of the housing, the diameter of which is larger than the width of the elongate second end and intermediate portion.

Further, the dimensions of the attachment part are partly defined by the number and dimensions of the gears, the bearings supporting the gears and the dimensions of the input and the output interface. In addition, the wall thicknesses of the housing parts contribute to increase the overall dimensions of the attachment part.

Since the attachment parts are normally used at applications in confined spaces where it is difficult to reach and access the fasteners to be secured or loosened, it is highly desirable to keep the dimensions of the attachment part as small as possible. It is further advantageous if the attachment part may readily be disassembled and reassembled for allowing service, maintenance and replacement of components.

At previously known attachment parts, the upper and lower housing parts are normally secured together by means of a number of fixations screws which are distributed all around the periphery of the housing and each of which engages the upper and the lower housing part. WO 2014/095517 A1 discloses such an attachment part.

At the previously known attachment parts, the use of fixations screws distributed all around the housing requires that the wall thickness of the upper and lower housing parts is sufficiently great for accommodating the screws and for providing sufficient strength to the wall portions surrounding the screws. The so required wall thickness thus adversely adds to the total dimension of the attachment part. In addition, the comparatively high number of fixation screws required for a secure interconnection of the housing parts renders assembling and disassembling of the attachment part cumbersome and time consuming. This in turn increases the operations and time needed for service, maintenance and replacement of the interior components of the attachment part.

SUMMARY

An object of the invention is therefore to provide an enhanced attachment part for a power tool, which solves or at least alleviates the problems of the prior art.

Another object is to provide such an attachment part which allows for reduced outer dimensions while maintaining the torque capacity.

A further object is to provide such an attachment part which reduces the operations and time needed for service, maintenance and replacement of at least some of the interior components.

According to a first aspect of the present disclosure there is thus provided an attachment part for a power tool, which attachment part comprises; an elongate housing including an upper housing part, a lower housing part, and interconnection means for interconnecting said upper and lower housing parts. An input gear for connection to an output shaft of a power tool is arranged at a first end of the housing. An output gear with an output connection is arranged at a second end of the housing. The interconnecting means comprises a sleeve member extending through a first central bore in the first end of the upper housing part, which sleeve member receives the input gear; and a fixation member extending through a second central bore in the first end of the lower housing part and which is arranged to be secured to the sleeve member for clamping the upper and lower housing parts.

By arranging the sleeve member and the fixation member extending through a respective bore at the first end of the upper and lower housing parts such that they may be secured together for clamping the upper and lower housing parts, a sufficient interconnection between the upper and lower housing parts is achieved, at least at the first end of the housing. By this means there is no need for arranging any fixation screws at the periphery of the first end and extending through the wall portions of the upper and lower housing parts, at the first end of the housing. The wall thickness of the upper and lower housing parts may thereby be reduced at the first end, which in turn reduces the overall dimensions of the attachment part. By such reduced overall dimensions it is possible to use the attachment part for fastening bolts, screws or the like at even more confined spaces than what has been possible hitherto.

Additionally, the reduced number of fixation screws facilitates mounting and dismounting of the housing, thereby reducing the time and effort needed for service, maintenance and replacement of the interior components of the attachment part.

Further, the arrangement of the sleeve member and the fixation member extending through a respective central bore arranged at the first end of the upper and lower housing part greatly enhances access to the interior components arranged at the first end of the housing. By loosening the fixation member from the sleeve member, it is possible to withdraw these two members from their respective central bore. Thereby the interior of the of the first end of the housing becomes accessible from the outside such that e.g. the first gear, the bearings supporting the first gear and any additional interior components arranged at the first end of the housing may be dismounted and replaced through the central bores, without separating the upper and lower housing parts. This highly facilitates and speeds up service, maintenance and replacement of the interior components.

The sleeve member and/or the fixation part may comprise at least one radially protruding clamping flange.

The sleeve member and the fixation part may comprise cooperating threads for securing the fixation part to the sleeve member.

The sleeve member may exhibit at least one first bearing support surface.

The fixation member may exhibit at least one second bearing support surface.

The sleeve member may exhibit an opening arranged to allow the input gear to mesh with the output gear or with an auxiliary gear arranged between the input gear and the output gear.

A radially protruding clamping flange of the sleeve member may be arranged in clamping contact with a first outer contact surface of the upper housing part which first contact surface is arranged around the first central bore.

Alternatively, a radially protruding clamping flange of the sleeve member may be arranged in clamping contact with an intermediate component arranged between said clamping flange and an outer surface of the upper housing part.

The intermediate component may form part of an interface head for connecting the attachment part to a power tool or an angle head.

A radially protruding clamping flange of the fixation member may be arranged in clamping contact with a second outer contact surface of the lower housing part, which second contact surface is arranged around the second central bore.

The attachment part may further comprising an interface head for connection of the attachment part to a power tool.

The he interface head may be formed integral with the sleeve member. Alternatively the interface head and the sleeve member may be formed of separate components.

The input gear may be formed integral with an input interface for connection to an output shaft of a power tool.

According to a second aspect, there is provided a tool assembly comprising a power tool and an attachment part as described above.

The tool assembly may further comprise an angle head arranged operatively between the power tool and the attachment part.

The power tool may be a nutrunner.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
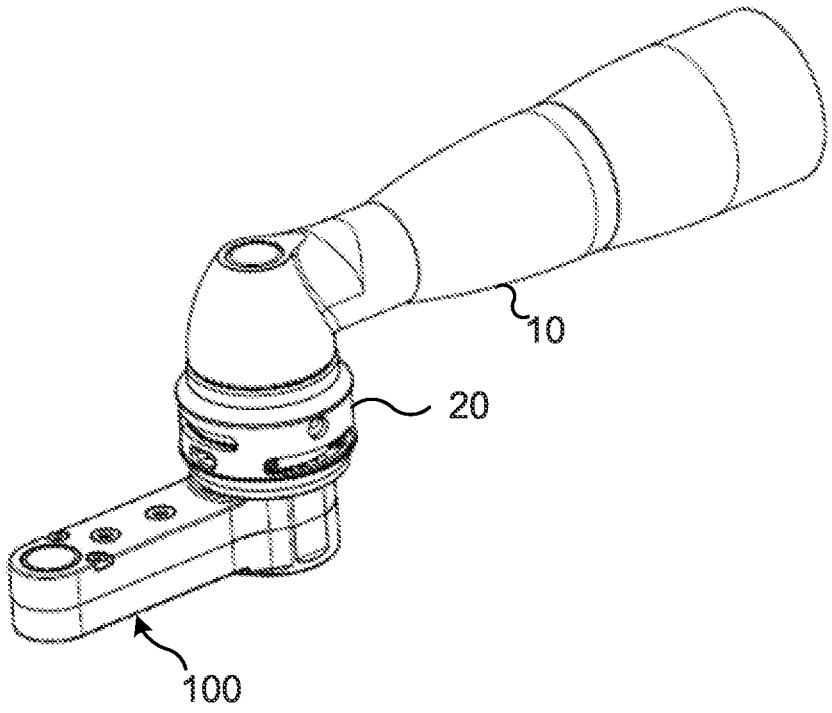
FIG. 1 is a perspective view of an attachment part according to a first embodiment of the invention, which is connected to an angle head by means of an adaptor.

FIG. 1 illustrates an attachment part 100 according to a first embodiment of the invention which is attached to an angle head 10 of a power tool (not shown) by means of an adaptor. In the shown example the adaptor 20 is an indexing adaptor which allows the attachment part 100 to be angularly adjusted in relation to the angle head 20. In other words, the attachment part 100 may be rotated about a (as shown in FIG. 1) vertical axis and fixed at different rotational positions relative to the angle head 10 such that the longitudinal direction of the attachment part is set at different angles relative to the longitudinal direction of the angle head. Such angular adjustment of the attachment part is normally referred to as indexing. By this means, access to nuts, bolts and the like which are to be fastened or loosened, in confined spaces, is facilitated.

With reference to FIGS. 2*a-f*, the attachment part 100 is of the closed end type and comprises an elongate housing 110 and an interface head 120. The interface head 120 protrudes above the housing 110 and is generally cylindrical. It comprises upper radially protruding flange portions 122 and lower radially protruding longitudinal splines 124 arranged to cooperate with corresponding means of the adaptor 20 shown in FIG. 1 for allowing the attachment part to be connected to and indexed relative to a power tool.

The elongate housing comprises an upper housing part 111 and a lower housing part 112, which housing parts are interconnected along a longitudinal median plane. The housing 110, just as the upper 111 and lower 112 housing parts exhibits a first end 113 and a second end 114. The first 113 and second 114 ends are rounded and the first end 113 exhibits a radius of curvature which is larger than the radius of curvature if the second end 114. The first 113 and second 114 ends are further connected by means of an intermediate portion 115 having a generally square cross section. The side walls of the intermediate portion 115 tapper slightly from the first end 113 towards the second end 114. At some alternative embodiments however, the side walls of the intermediate portion may be mutually parallel or even diverging towards the second end. The upper housing part 111 further exhibits a first bore 117 which is centrally arranged at the first end 113. The lower housing part 112 exhibits a second bore 118 (FIG. 2*d*) which is centrally arranged at the first end 113.

A flat and rectilinear gear train 130 is accommodated in the interior of the housing 110. The gear train is arranged for transmitting rotational movement and torque from an output axis (not shown) of the angle head 10 to an output interface of the attachment part 100. The gear train 130 comprises an input gear 131 arranged at the first end 113 of the housing 110 and an output gear 132 arranged at the second end 114 of the housing 110. In the shown example, three intermediate gears 133, 134, 135 are arranged between the input gear 131 and the output gear 132 such that the input gear 131 meshes with intermediate gear 133, which also meshes with intermediate gear 134, which also meshes with intermediate gear 135, which in turn also meshes with the output gear 132. The intermediate gears 133-135 are supported by bearings arranged on respective shafts which are received in corresponding openings arranged in the upper 111 and lower 112 housing parts. The output gear 132 is supported by sliding bearings received by the housing parts 111, 112.

The input gear 121 is formed integral with an input interface 136 which exhibits a square recess which is arranged and dimensioned for receiving a square drive (not shown) at an output shaft (not shown) of the angle head 10. Typically, the input interface 136 may be configured to receive a standardized square drive. In the shown example, it is configured to receive a ⅜ inch square drive. However, the input interface may also be configured for connection to other output shafts of an angle heads or power tools, which output shafts may have many other geometries. Additionally, the input gear and the input interface may in some embodiments be formed as separate interconnected components.

The output gear 132 is provided with an output interface 132*a*. The output interface 132*a* is tubular with an axial bore 132*b* and is arranged coaxially inside the output gear 132. In this example the output interface 132*a*, comprises a internal wall arranged in the bore 132*b* (not visible) which wall exhibits a square through opening configured to receive a standardized tool or screw bit (not shown) with a square drive. However, the output interface could be configured in many other ways. E.g. it may be configured with a hexagonal geometry to directly engage a bolt, nut or the like which is to be fastened or loosened. The output interface may also be arranged as a square drive or the like which protrudes out from the housing 110.

The attachment part 100 further comprises a sleeve member 140, a fixation member 150 and an interface head 120. These members 140, 150, 120 are arranged for interconnecting the upper 111 and lower 112 housing parts by clamping the housing parts at the first end 113. The sleeve member 140 comprises a generally cylindrical sleeve 141 with four radially outwardly protruding clamping flanges 142 arranged at the upper edge of the sleeve 141.

A through opening 143 extends from the lower edge of the sleeve upwardly.

The through opening 143 is arranged for allowing the input gear 131 to mesh with intermediate gear 133. An internal thread 144 is arranged inside the sleeve 141 in proximity to the lower edge.

The fixation member 150 is generally rotational symmetrical and comprises an upper cylindrical shaft 151, an intermediate cylindrical portion 152 and a lower clamping flange 153 which protrudes radially outwards from the lower edge of the cylindrical portion 152. The cylindrical portion 152 is provided with an external thread 154 which corresponds to the internal thread 144 of the sleeve member 140.

Figure 2A:
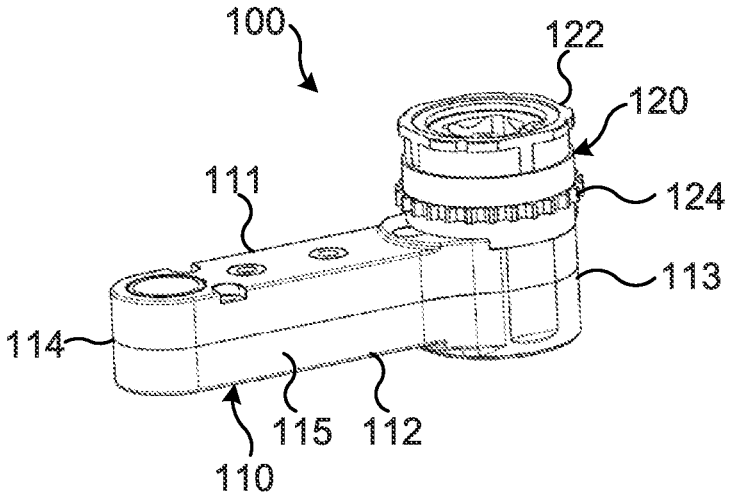
FIG. 2*a* is a perspective view of the attachment part shown in FIG. 1.
Figure 2B:
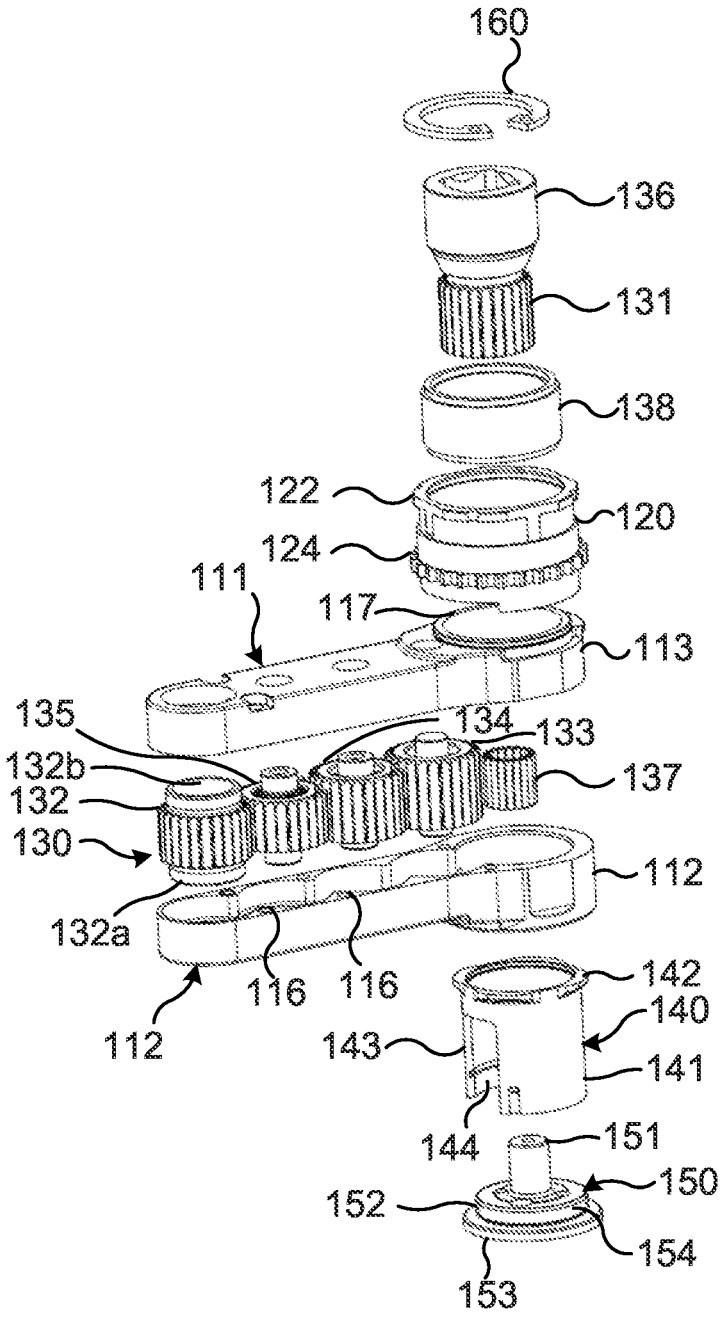
FIG. 2*b* is an exploded view in perspective of the attachment part shown in FIG. 1.
Figure 2C:
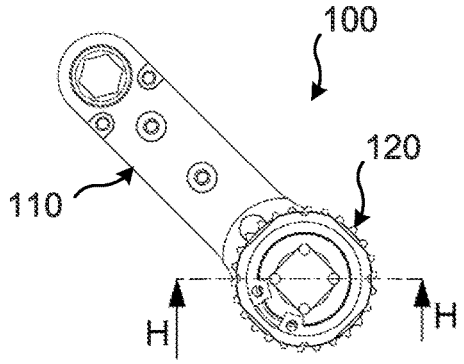
FIG. 2*c* is a top view of the attachment part shown in FIG. 1.
Figure 2D:
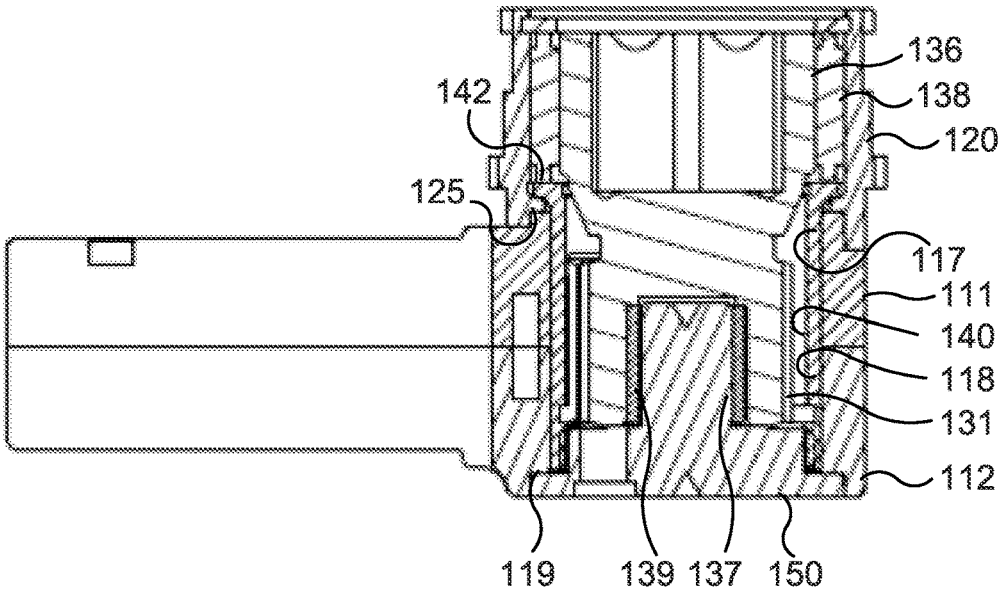
FIG. 2*d* is a section in enlarged scale along line H-H in FIG. 3*c*.
Figure 2E:
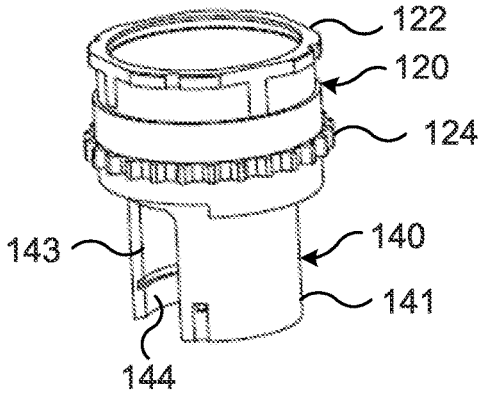
FIGS. 2*e* and *f* are a perspective view and a section through two components of the attachment part shown in FIG. 1.
Figure 2F:
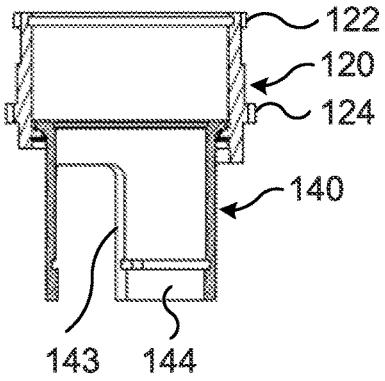

As best seen in FIG. 2*d* the sleeve member 140 and the fixation member 150 and the interface head 120 cooperate to clamp the upper 111 and lower 112 housing parts in the following manner. Further and as best seen in FIGS. 2*b* and 2*f*, the sleeve member and the interface head are formed as two separate components at this embodiment. When assembling the attachment part 100 the output gear 132 and the intermediate gears 133-135 are positioned in the lower housing part 112 and the upper housing part 111 is aligned and brought into contact with the lower housing part 112. Thereafter the two housing parts are interconnected by fixation screws (not shown). The fixation screws are inserted through fixation holes 116 arranged in the side walls of the lower housing part's 112 second end 114 and intermediate portion 115 and threadedly engaged in corresponding holes (not shown) arranged in the side walls of the second end and intermediate portion of the upper housing part 111.

Thereafter, the sleeve member 140, the interface head 120 and the fixation member 150 are mounted for accomplishing a strong and secure interconnection of the upper 111 and lower 112 housing parts' first ends 113. The interface head 120 is first positioned on top of the upper housing part 111, such that it surrounds the first bore 117. Thereafter, the sleeve member is inserted from above through the interface head 120 and the first bore 117 until the clamping flanges 142 come into supporting contact with and inwardly protruding radial flange 125 of the interface head 120. The sleeve member 140 should be rotationally oriented such that the through opening 143 faces the intermediate gears 133-135 and allows a portion of intermediate gear 133 to extend through the opening 143 for being able to mesh with the input gear 131, when mounted.

Then a first bearing 137 is mounted inside the input gear 131. The fixation member 115 is inserted from below through the second bore 118 and the exterior thread 154 is engaged with the interior thread 144 of the sleeve member by rotating the fixation member 150. For this purpose the lower outer surface of the fixation member 150 may be provided with suitable tool receiving recesses (not shown). During rotation of the fixation member, the clamping flange 153 of the fixation member will contact the lower surface of the lower housing part 112, around the second bore 118. For a proper and secure positioning of the fixation member 150, the lower housing part 112 exhibits a circular positioning recess 119 arranged at the edge of the second bore 118 and having a diameter which corresponds to the diameter of the fixation member's 150 clamping flange 153. During such securing of the fixation member 150 to the sleeve member 140, it is possible to select a suitable securing torque which results in a corresponding clamping force by which the upper 111 and lower 112 housing parts are pressed together. By this means the upper 111 and lower 112 housing parts are readily interconnected and securely held together at the first end 113 of the housing 110.

When the housing parts 111, 112 have been interconnected, a second bearing 138 for supporting the input interface 136 is inserted the into the interface head 120. The first gear 131 with the input interface 136 is then inserted from above, through the interface head 120 and the sleeve member 140, such that a lower bore 139 of the first gear 131 and the first bearing 137 receives the shaft 151 of the fixation member 150. When so mounted the first gear 131 is supported by the first bearing which is supported by a circumferential exterior bearing support surface on the shaft 151 of the fixation member. The outer circumferential surface of the input interface 136 is supported by the second bearing 138 which in turn is supported by the interior bearing supporting surface of the interface head 120.

Finally, the first gear 131 and the input interface 136 are axially locked in position by inserting a locking washer 160 into an interior circumferential groove of the interface head.

Figure 3A:
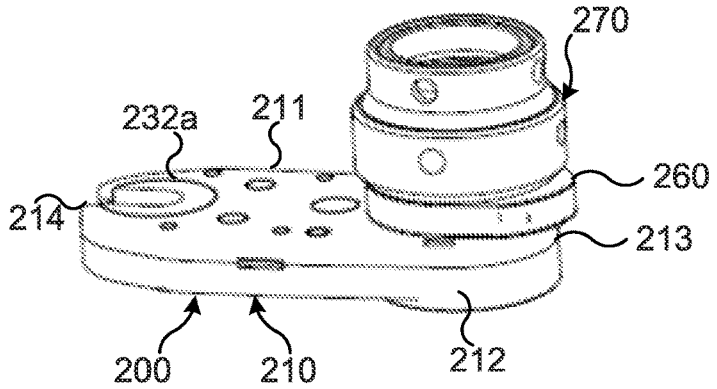
FIG. 3*a* is a perspective view of an attachment part according to a second embodiment of an attachment part according to the invention and an adaptor for connecting the attachment part to a power tool or an angle head.
Figure 3B:
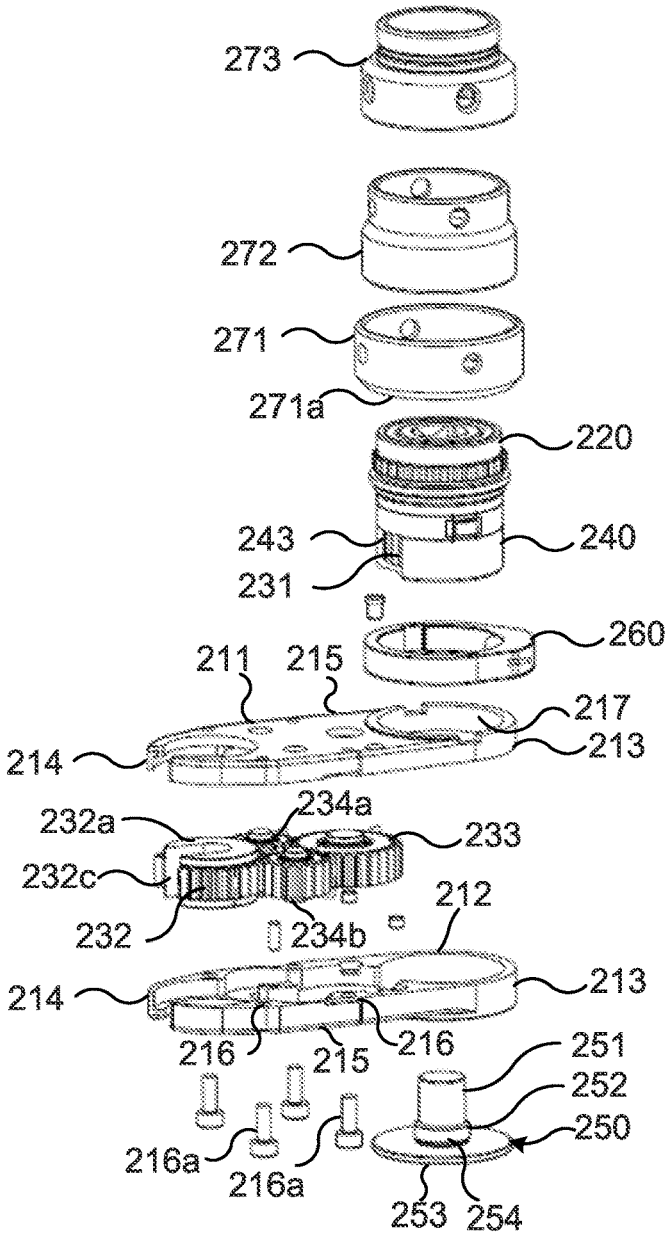
FIG. 3*b* is an exploded view in perspective of the attachment part shown in FIG. 3*a*.
Figure 3C:
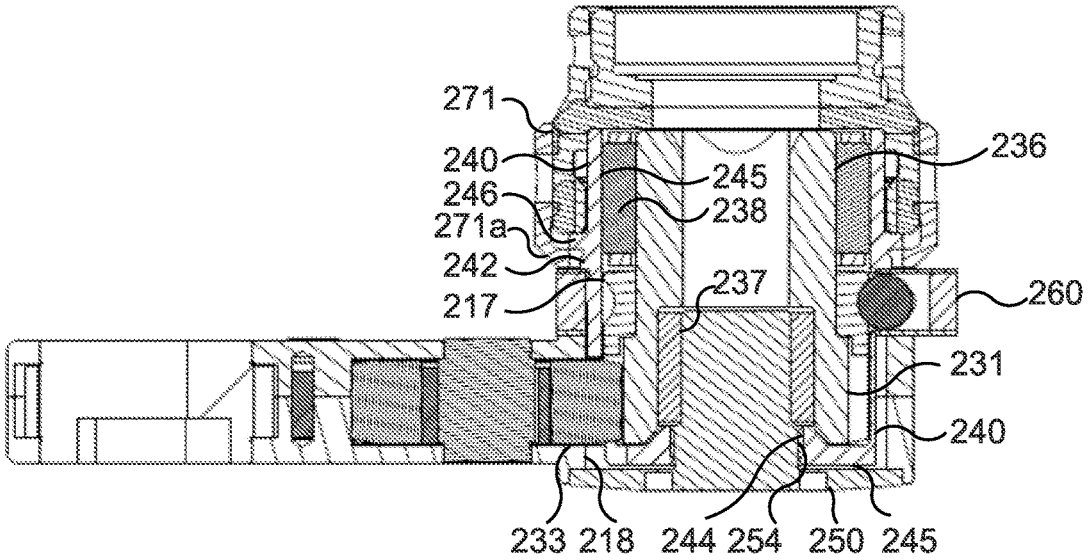
FIG. 3*c* is a section in enlarge scale of the attachment part shown in FIG. 3*a*.

FIGS. 3*a-c* illustrates an attachment part 200 according to a second embodiment of the invention. In the figures, the attachment part is illustrated when connected to an indexing adaptor 270 This attachment part 200 is of the open end type. Thus, the output interface 232*a* and the output gear 232 exhibit a radial slit 232C such that the output interface may be slid onto a pipe or the like in the radial direction and engaged with a nut, a bolt or the like which is thread onto and encloses the pipe. The open end attachment parts may thus be used for fastening and loosening e.g. nuts that surrounds a pipe such as an automotive brake fluid pipe.

The attachment part 200 comprises a housing 210 and an interface head 220 which protrudes upwards from the housing 210. The housing 210 comprises an upper housing part 211 and a lower housing part 210 which are interconnected along a longitudinal plane of the housing 210. The housing 210, the upper 211 and the lower 212 housing parts exhibit a first end 213 and a second end 214. At this embodiment the second end 214 is open in the longitudinal direction.

An input gear 131 is made integral with an input interface 236 and the input gear 131 is arranged inside the housing 210 at the first end 213. The output gear 232 is arranged inside the housing 210, at the second end 214. The output interface 232*a* is arranged concentrically inside the output gear 232. Intermediate gears 233, 234*a*, 234*b* are arranged inside an intermediate portion 215 of the housing 210 between the first 213 and second 214 ends.

The intermediate gears comprises one intermediate gear 233 which meshes with the input gear 231 and with two further intermediate gears 234*a*, 234*b*, arranged in parallel. The two further intermediate gears 234*a*, 234*b* mesh with the output gear 232. Hereby it is possible to fully rotate the output gear 232 in spite of the radial slit 232*c* arranged in the output gear 232. The attachment part 200 further comprises a reverse stop device 260. The reverse stop device 260 cooperates, during reverse rotation, with the input gear 231 for stopping the rotation of the output gear as soon as the radial slit 232*c* of the output interface 232*a* and the output gear 232 is aligned with the open second end 214 of the housing. By this means it is assured that the output interface 232*a* may readily be disengaged from the nut, bolt or the like when the fastening or loosening has been completed. Such reverse stop devices are well known to the skilled person and are not described more in detail here.

The second end 214 and the intermediate portion 215 of the upper 211 and lower 212 housing parts are interconnected by means of fixations screws 216*a* which extend trough holes 216 in the lower housing part and are treadedly engaged in corresponding holes (not shown) in the upper housing part 211.

At the first end 213 the upper 211 and lower 212 housing parts are interconnected by means of a sleeve member 240 and a fixation member 250 which are secured together. At this embodiment the sleeve member 240 is formed integral with the interface head 220, such that these members form a single component. The sleeve member 240 extends through a annular opening in the revers stop device 260 and a first central bore 217 arranged at the first end of the upper housing part 211. A fixation member 250 extends through a second central bore 218 arranged at the first 213 end of the lower housing part 212.

The sleeve member 240 exhibits a first radially protruding clamping flange 242 which bears against an upper surface of the reverse stop device 260. A lower surface of the reverse stop device 260 in turn, bears against an upper surface of the upper housing part 211, surrounding the first bore 217. The fixation member 250 is secured to the sleeve member 240 by means of external threads 254 arranged at an intermediate portion 251 of the fixation member 250 and cooperating with corresponding internal threads 244 arranged at a bottom wall portion 245 of the sleeve member 240. The fixation member 250 comprises a radially protruding clamping flange 253 which bears against a recessed lower surface of the lower housing part 212. By rotationally tightening the fixation member 250 to the sleeve member 240, the upper 211 and lower 212 housing parts are clamped by the sleeve member's first clamping flange 242, via the reveres stop device 260 and the fixation member's 250 clamping flange 253.

Additionally at this embodiment, the sleeve member 240 comprises a second radially outwardly protruding flange 246 which is arranged to bear against a lower radially inwardly protruding portion of a first adaptor ring 271 forming part of the adaptor 270. The adaptor 270 further comprises a second adaptor ring. FIG. 3*b* illustrates two such alternative second adaptor rings 272, 273.

In addition and as indicated in the drawings, the component formed by the sleeve member 240 and the interface head 220 as well as the reverse stop device 260 are provided with form locking means which cooperates with corresponding means of the upper housing part 211 for preventing relative rotation between these components.

At this embodiment, the sleeve member 240 and the fixation member 250 are used not only for interconnecting the upper 211 and lower 212 housing parts at the first end 213 but also for fixation of the revers stop device 260 and the adaptor 270 to the attachment part 200.

Further, at this embodiment the fixation member 250 comprises an upwardly extending shaft 251, the circumferential surface of which forms a support surface for a first bearing 237 arranged inside the input gear 231. The sleeve member 240 also exhibits, at its upper portion, an internal cylindrical surface 245 which forms a bearing support surface for a second bearing 238 supportingly arranged around the input interface 236.

As in the first embodiment described above, the sleeve member 240 exhibits an opening 243 for allowing intermediate gear 233 to mesh with the input gear 231.

Figure 4:
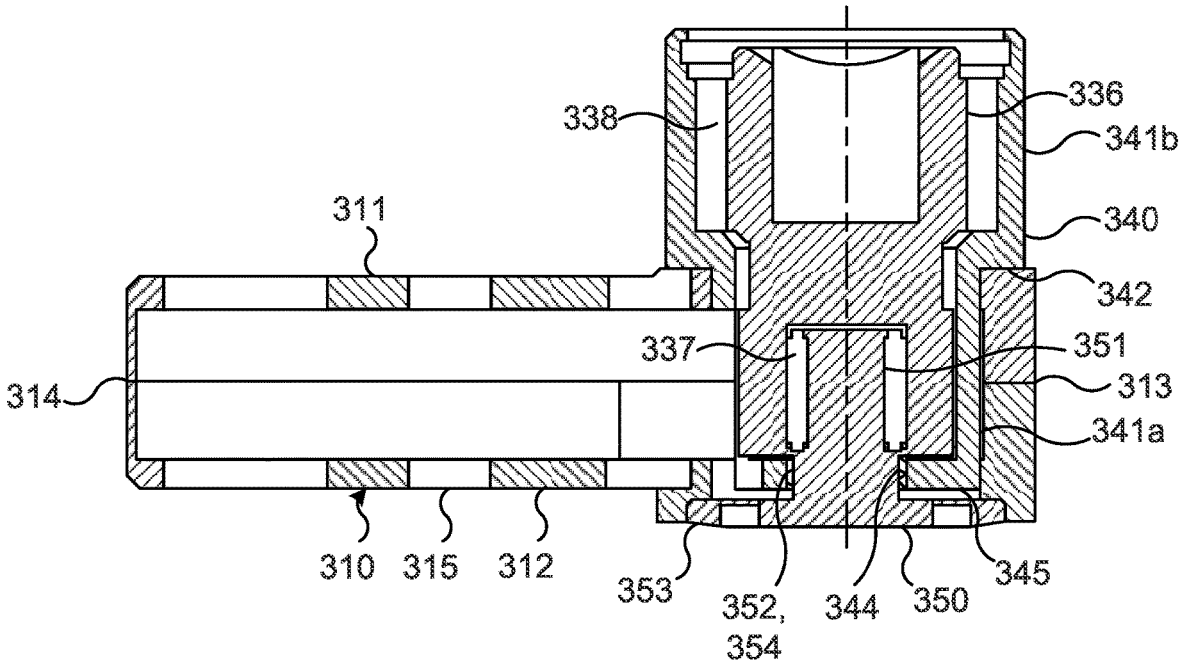
FIG. 4 is a section through an attachment part according to a third embodiment of the invention.

In FIG. 4 an attachment part according to a third embodiment is shown. The attachment part 300 comprises a housing 310 including an upper housing part 311 and a lower housing part 312. The housing 310, the upper 311 and the lower 312 housing parts exhibit a first end 313, a second end 314 and an intermediate portion 315. A first central bore 317 is arranged at the first end of the upper housing part 311 and a second bore 318 s arranged at the first end 313 of the lower housing part 312. A drive train (not shown) comprising two intermediate gears and an output gear are arranged inside the second end 314 and the intermediate portion 315 of the housing 310. At the first end 313, an input gear 331 integrally formed with externally protruding input interface 336 is arranged. At the first end 313, the upper 311 and lower 312 housing parts are interconnected by means of a sleeve member 340 and a fixation member 250 which are secured together.

The sleeve member 340 comprises a lower cylindrical portion 341*a* having a first diameter and an upper cylindrical portion 341*b* having a second diameter which is larger than the first diameter. At the junction between the lower 341*a* and the upper 341*b* portions a clamping flange 342 is formed such that it protrudes radially outwards from the upper edge of the lower portion 341*a*. At the lower end, the sleeve member 340 exhibits a bottom wall portion 345 which extends inwardly from the lower edge of the lower cylindrical portion 341*a*. The bottom wall portion 345 is provided with a central circular through opening with an internal thread 344.

The fixation member 350 comprises an upper vertically extending shaft 351, a cylindrical intermediate portion 352 with an external thread 354 and a lower radially outwardly protruding clamping flange 353.

For interconnecting the first end 313 of the upper 311 and lower 312 housing parts, the lower cylindrical portion 341*a* of the sleeve member 340 is inserted from above through the first bore 317 until the clamping flange 342 of the sleeve member makes contact with an upper surface around the first bore 317. The fixation member 350 is inserted from below through the second bore 318. By rotating the fixation member 350 the external thread 354 of the intermediate portion 352 engages the internal thread 344 of the bottom wall portion 345. Continued fastening rotation of the fixation member 350 will bring the clamping flange 353 of the fixation member 350 into contact with a recessed surface around the second bore 318. By this means, the upper housing part 311 and the lower housing part 312 are clamped between the two clamping flanges 342, 353 to thereby be strongly and securely interconnected. At this embodiment the shaft 351 of the fixation member 350 forms a bearing support surface for a first bearing 337 arranged inside the input gear 331. The inner cylindrical surface of the sleeve member's 340 upper portion 341*b* forms a support surface for a second bearing 338 arranged outside of the input interface 336.

At a not shown embodiment the sleeve member and the fixation member are provided with securing means other than threads. Examples of such securing means are cooperating engagement members of the bayonet type, snap engagement members and other form-locking arrangements.

At another not shown embodiment the clamping flange of the sleeve member is arranged to be in clamping contact with an intermediate component other than an interface head or a reverse stop device, which is arranged between said clamping flange and the upper housing part. Examples of such intermediate components comprise adaptor rings forming part of an adaptor and rings, sleeves and other components forming part of other auxiliary devices.

As readily understood from the above description of different embodiments, the arrangement of a sleeve member and a fixation member which are secured together for clamping the upper and lower housing parts provide for a quick and easy way for accomplishing a strong and secure interconnection between the upper and lower housing parts. In addition the arrangement also provides for quick and easy dismounting for facilitating service, maintenance and replacement of the input gear, the input interface, the bearings supporting these components and any other components arranged at the inside of the first end of the housing. To this end it may be noted that these interior components may be directly accessed, removed and replaced through the first and/or second bore, simply by dismounting the fixation member and, at some instances, the sleeve member. The arrangement also eliminates the need of arranging a number of fixation screws or the like through the side wall of the housing parts, around the periphery of the first end. This in turn allows for that the material thickness of the housing parts may be reduced thereby to reduce the overall dimensions of the attachment part.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. An attachment part for a power tool, the attachment part comprising:

an elongated housing including an upper housing part and a lower housing part;

an interconnection structure that interconnects the upper and lower housing parts;

an input gear for connection to an output shaft of a power tool, wherein the input gear is arranged at a first end of the housing; and an output gear with an output interface, wherein the output gear is arranged at a second end of the housing;

wherein the interconnection structure comprises:

a sleeve member extending through a first central bore at the first end of the upper housing part, wherein the sleeve member receives the input gear; and a fixation member extending through a second central bore at the first end of the lower housing part and which is arranged to be secured to the sleeve member for clamping the upper and lower housing parts, wherein the sleeve member has an opening arranged to allow the input gear to mesh with the output gear or with an auxiliary gear arranged between the input gear and the output gear.

2. The attachment part according to claim 1, wherein at least one of the sleeve member and the fixation part comprises at least one radially protruding clamping flange.

3. The attachment part according to claim 2, wherein a radially protruding clamping flange of the sleeve member is arranged in clamping contact with a first outer contact surface of the upper housing part, and the first contact surface is arranged around the first central bore.

4. The attachment part according to claim 2, wherein a radially protruding clamping flange of the sleeve member is arranged in clamping contact with an intermediate component arranged between the clamping flange and an outer surface of the upper housing part.

5. The attachment part according to claim 4, wherein the intermediate component forms part of an interface head for connecting the attachment part to a power tool.

6. The attachment part according to claim 2, wherein a radially protruding clamping flange of the fixation member is arranged in clamping contact with a second outer contact surface of the lower housing part, and the second contact surface is arranged around the second central bore.

7. The attachment part according to claim 1, wherein the sleeve member and the fixation part comprise cooperating threads for securing the fixation part to the sleeve member.

8. The attachment part according to claim 1, wherein the sleeve member has at least one first bearing support surface.

9. The attachment part according to claim 8, wherein the fixation member has at least one second bearing support surface.

10. The attachment part according to claim 1, further comprising an interface head for connection of the attachment part to a power tool.

11. The attachment part according to claim 10, wherein the interface head is formed integrally with the sleeve member.

12. The attachment part according to claim 10, wherein the interface head and the sleeve member are formed of separate components.

13. The attachment part according to claim 1, wherein the input gear is formed integrally with an input interface for connection to an output shaft of a power tool.

14. The tool assembly comprising a power tool and the attachment part according to claim 1.

* * * * *